US010669080B2

(12) United States Patent
Stevens

(10) Patent No.: US 10,669,080 B2
(45) Date of Patent: Jun. 2, 2020

(54) TAMPER EVIDENT CLOSURE

(71) Applicant: Sonoco Development, Inc., Hartsville, SC (US)

(72) Inventor: James P. Stevens, Myrtle Beach, SC (US)

(73) Assignee: Sonoco Development, Inc., Hartsville, SC (US)

( * ) Notice: Subject to any disclaimer, the term of this patent is extended or adjusted under 35 U.S.C. 154(b) by 51 days.

(21) Appl. No.: 16/135,246

(22) Filed: Sep. 19, 2018

(65) Prior Publication Data

US 2020/0087038 A1 Mar. 19, 2020

(51) Int. Cl.

*B65D 43/26* (2006.01)
*B65D 41/48* (2006.01)
*B65D 43/02* (2006.01)

(52) U.S. Cl.

CPC ..... *B65D 43/265* (2013.01); *B65D 41/48* (2013.01); *B65D 43/0237* (2013.01); *B65D 43/26* (2013.01); *B65D 43/267* (2013.01); *B65D 2101/0015* (2013.01); *B65D 2543/00888* (2013.01)

(58) Field of Classification Search

CPC ..... B65D 41/48; B65D 43/0237; B65D 2101/0015; B65D 2543/00888; B65D 43/26; B65D 43/265; B65D 43/267

USPC ..... 220/285

See application file for complete search history.

(56) References Cited

U.S. PATENT DOCUMENTS 3,294,274 A 12/1966 Spitzberg
3,773,207 A 11/1973 Dokoupil et al.
3,977,561 A 8/1976 Strobe et al.
4,006,839 A 2/1977 Thiel et al.
4,091,930 A 5/1978 Buchner et al.
4,433,793 A 2/1984 Ingemann
4,535,889 A 8/1985 Terauds
4,759,463 A 7/1988 Mazoin
(Continued)

FOREIGN PATENT DOCUMENTS

DE 9205256 U1 6/1992
DE 29601108 U1 3/1996
(Continued)

OTHER PUBLICATIONS

International Search Report/Written Opinion for Application No. PCT/US2019/043665 dated Nov. 14, 2019.

*Primary Examiner* — James N Smalley
(74) *Attorney, Agent, or Firm* — Nelson Mullins Riley & Scarborough, LLP

(57) ABSTRACT

The invention is directed to a container having a tamper evidence collar integrally formed on the container body, wherein the tamper evidence collar comprises: an annular portion which extends circumferentially outwardly from the container body; a discontinuous skirt portion which extends vertically from the annular portion, extends substantially circumferentially about the container body; a tamper evidence tab disposed in the circumferential location of the skirt discontinuity, wherein the tab comprises: an annularly extending portion aligned with the annular portion of the collar; and a skirt portion aligned with the skirt of the collar, one or more pins that rotatably join the tab to the tamper evidence collar; and at least one frangible web which connects the tab to the tamper evidence collar prior to actuation of the tab.

20 Claims, 9 Drawing Sheets

(56) References Cited

U.S. PATENT DOCUMENTS 4,765,463 A 9/1988 Chanel
4,798,301 A 1/1989 Bullock et al.
4,881,656 A 11/1989 Chumley et al.
4,890,758 A 1/1990 Gailus
4,930,656 A 6/1990 Blanchette
4,966,292 A 10/1990 Marino
4,998,622 A 3/1991 Drack
5,002,198 A 3/1991 Smith
5,027,959 A 7/1991 Luukkonen
5,027,969 A * 7/1991 Lesquir ..... B65D 43/0212 220/265
5,040,695 A 9/1991 Adams et al.
5,052,574 A 10/1991 McKinnon et al.
5,111,953 A 5/1992 Faust et al.
5,111,954 A 5/1992 Gaudreault
5,115,934 A 5/1992 Nelson
5,129,531 A 7/1992 Beck et al.
5,170,905 A 12/1992 Luch
5,219,074 A 6/1993 Mizuno et al.
5,219,087 A 6/1993 Christensson
5,249,694 A 10/1993 Nelson
5,287,959 A 2/1994 Hansen et al.
5,307,948 A 5/1994 Blackburn et al.
D352,000 S 11/1994 Hansen et al.
5,421,473 A 6/1995 McCrossen
5,437,386 A * 8/1995 Von Holdt ..... B65D 43/0206 220/268
5,507,405 A 4/1996 Thomas et al.
5,507,406 A 4/1996 Urciuoli et al.
5,511,679 A 4/1996 Beck
5,511,680 A 4/1996 Kinne
5,528,814 A 6/1996 Luch et al.
5,573,134 A 11/1996 Chenault et al.
5,607,075 A 3/1997 Burgdorf et al.
5,617,968 A 4/1997 Luburic
5,626,251 A 5/1997 Luburic et al.
5,683,771 A 11/1997 Tropsha
5,695,087 A 12/1997 Tutton et al.
5,842,593 A 12/1998 Von Holdt
5,875,913 A 3/1999 Letica
5,897,011 A 4/1999 Brilliant et al.
5,931,332 A 8/1999 Mygatt
5,938,068 A 8/1999 Atkins et al.
5,960,979 A * 10/1999 Van Den Brink ..... B65D 25/32 220/266
5,979,690 A 11/1999 Hartley
6,000,570 A 12/1999 Nelson
RE36,729 E 6/2000 Luch et al.
6,116,501 A 9/2000 LaBelle
6,135,304 A 10/2000 Wyslotsky
6,168,044 B1 1/2001 Zettle et al.
6,279,774 B1 8/2001 Clute et al.
6,257,435 B1 11/2001 Chedister et al.
6,564,958 B1 5/2003 Ramsey et al.
6,572,909 B1 6/2003 Bagwell et al.
6,604,645 B1 8/2003 Vaupotic
6,712,233 B2 3/2004 Arshinoff
6,772,901 B2 8/2004 Witt
6,926,165 B2 8/2005 Conti
7,004,341 B2 2/2006 Shenkar et al.
7,063,230 B2 6/2006 Ciccone
7,073,680 B2 7/2006 Boback et al.
7,097,058 B2 8/2006 Wellman et al.
7,118,003 B2 10/2006 Sellari et al.
7,134,567 B2 11/2006 Lubric
7,207,457 B2 4/2007 Schwarz
7,243,813 B2 7/2007 Krueger
7,311,218 B2 12/2007 Varadarajan
7,568,589 B2 8/2009 Vovan
7,631,776 B2 12/2009 Vovan et al.
7,712,626 B2 5/2010 Vovan
7,946,441 B2 5/2011 Habitz et al.
7,992,743 B2 8/2011 Vovan
8,011,566 B2 9/2011 Robertson et al.
8,083,086 B2 12/2011 Alveres
8,083,089 B2 12/2011 Vovan
8,127,961 B2 3/2012 Vovan
8,251,242 B2 8/2012 Vovan
8,308,010 B2 11/2012 Letica et al.
8,322,553 B2 12/2012 Rider, Jr. et al.
8,381,946 B2 2/2013 Everson
8,459,486 B2 6/2013 Luburic et al.
8,608,008 B2 12/2013 Geingras et al.
8,714,394 B2 5/2014 Wulf
8,794,471 B2 8/2014 Bontrager et al.
8,833,589 B2 9/2014 Vovan
8,839,975 B2 9/2014 Luburic
8,851,315 B2 10/2014 Vovan
8,925,755 B2 1/2015 Lesquir et al.
9,102,446 B2 8/2015 Kowal et al.
9,187,209 B1 11/2015 Hanna et al.
9,278,786 B2 3/2016 Vovan et al.
2002/0088804 A1 7/2002 Omura
2003/0052133 A1 3/2003 Hayes et al.
2003/0160051 A1 8/2003 Ciccone
2004/0011791 A1* 1/2004 Oh ..... B65D 43/021 220/285
2004/0134910 A1 7/2004 Colombo
2006/0163265 A1 7/2006 De Candido
2006/0201946 A1 9/2006 Witt
2006/0255054 A1 11/2006 Vovan
2006/0261070 A1 11/2006 Robertson et al.
2006/0266750 A1 11/2006 Lesquir
2006/0278652 A1 12/2006 Vovan et al.
2006/0289549 A1 12/2006 Vovan
2007/0012710 A1 1/2007 Vovan
2007/0045317 A1 3/2007 Rosender et al.
2007/0062948 A1 3/2007 Albrecht et al.
2007/0108210 A1 5/2007 Alveres et al.
2007/0138046 A1 6/2007 Vovan
2007/0138180 A1 6/2007 Vovan
2007/0164027 A1 7/2007 Auer
2007/0196541 A1 8/2007 Vovan et al.
2007/0272689 A1* 11/2007 Mitsuhashi ..... A61B 10/0096 220/200
2008/0000904 A1 1/2008 Vovan
2008/0006632 A1 1/2008 Vovan
2008/0185383 A1 8/2008 Philippe et al.
2008/0257886 A1* 10/2008 Luburic ..... B65D 43/0212 220/285
2009/0021026 A1 1/2009 Collier
2009/0057313 A1 3/2009 Alvares
2009/0206082 A1 8/2009 Vovan
2016/0257454 A1* 9/2016 Myer ..... B65D 43/0254
2017/0334610 A1* 11/2017 Noer ..... B65D 43/0204
2018/0244438 A1* 8/2018 Morichon ..... B65D 43/162

FOREIGN PATENT DOCUMENTS

DE 10140255 A1 2/2003
EP 1052183 A1 11/2000
EP 1312560 5/2003
GB 2257118 1/1993
WO WO 85/01030 A1 3/1985

* cited by examiner

TAMPER EVIDENT CLOSURE

FIELD OF THE INVENTION

The present invention relates generally to containers and closures for containers, and more particularly, to tamper evident containers and tamper evident closures for containers.

BACKGROUND

Containers are often formed with tamper evident mechanisms which indicate to a consumer whether the closure has been removed and, as a result, whether the quality of the product inside the container has potentially been compromised (i.e. via contamination, moisture, oxygen, etc.). A common tamper evidence mechanism comprises a tear strip or a tear tab on the closure which is located so as to prevent or inhibit removal of the closure until such time as the tear strip/tab is removed. This poses the disadvantages, however, of (a) generating unnecessary waste elements that must be disposed of, (b) creating a potential choking or swallowing hazard if the removed strip/tab is not properly disposed of, and/or (c) potentially contaminating the container contents with a strip/tab that is prematurely separated, such as during the manufacturing, filling, or consumption processes.

The present inventors, through ingenuity and hard work, have developed a container and closure combination which provides tamper evidence without use of a tab or strip which is completely separated from the packaging structure, thereby avoiding the disadvantages set forth above. In certain embodiments, actuation of the tab additionally aids in removal of the closure from the container.

BRIEF SUMMARY

In an embodiment, the invention is directed to a container comprising a container body and a tamper evidence collar integrally formed on the container body, wherein the tamper evidence collar comprises: an annular portion which extends circumferentially outwardly from the container body; a discontinuous skirt portion which extends vertically from the annular portion, extends substantially circumferentially about the container body; and a tamper evidence tab disposed in the circumferential location of the skirt discontinuity. In an embodiment, the tab comprises: an annularly extending portion aligned with the annular portion of the collar; and a skirt portion aligned with the skirt of the collar. The collar, in an embodiment, additionally comprises one or more pins that rotatably join the tab to the tamper evidence collar; and at least one frangible web which connects the tab to the tamper evidence collar prior to actuation of the tab.

In another embodiment, the invention is directed to a container and closure system comprising: a container body and a tamper evidence collar integrally formed on the container body, wherein the collar comprises: an annular portion which extends circumferentially outwardly from the container body; a discontinuous skirt portion which extends vertically from the annular portion, extends substantially circumferentially about the container body; and a tamper evidence tab disposed in the circumferential location of the skirt discontinuity. In an embodiment, the tab comprises: an annularly extending portion aligned with the annular portion of the collar and a skirt portion aligned with the skirt of the collar. The collar, in an embodiment, additionally comprises one or more pins that rotatably join the tab to the tamper evidence collar, at least one frangible web which connects the tab to the tamper evidence collar prior to actuation of the tab, and a closure which can be removably fitted on the container body.

In yet another embodiment, the invention is directed to a method of using the container and closure system set forth above comprising first pulling a top portion of the tab outwardly until the frangible portion breaks and the tab rotates on the pins. When the lower edge of the skirt of the closure becomes accessible, then pulling upwardly on the closure, away from the container.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Generally speaking, the invention is directed to a container with a tamper evidence element and, in some embodiments, a complementary closure for the container. In the invention, the tamper evidence feature is formed integrally with the packaging structure and is not removable or separatable from the packaging. The invention provides distinct advantages—(a) the tamper evidence element need not be disposed of after opening the container, (b) the tamper evidence feature does not create a potential choking or swallowing hazard, and/or (c) the tamper evidence feature is not likely to be inadvertently separated from and placed with a container, as a potential contaminate, during the manufacturing, filling, or consumption processes.

In an embodiment, the container may comprise a body portion and a flat bottom wall. In an embodiment, the container comprises an open top end and an upper rim. The container body may comprise a continuous cylindrical side wall or may have a cylindrically-tapered side wall. However, any shape or configuration of the container may be utilized in the invention. For example, the container may be generally square, rectangular, or elliptical in cross section. Likewise, the container may have a cylindrical mouth portion, but may be bulbous, square, or irregularly shaped throughout its body structure.

In an embodiment, the container closure, i.e. the lid, may be shaped and configured to fit onto the mouth of the container. In an embodiment, the closure may be the same shape as the container, but this need not be the case. Any closure shape and configuration known in the art is encompassed within the invention. The closure may be re-closable in some embodiments. In some embodiments, the closure is snap-fit onto the container and/or is in a removably sealed engagement with the container.

In an embodiment, the tamper evidence feature is provided in the form of a rotating hinged tab. In this embodiment, the tab may have one or more pins disposed through one or more portions of the tab and/or container elements which may allow the tab to rotate from a closed position to an open position on the pins.

Figure 1:
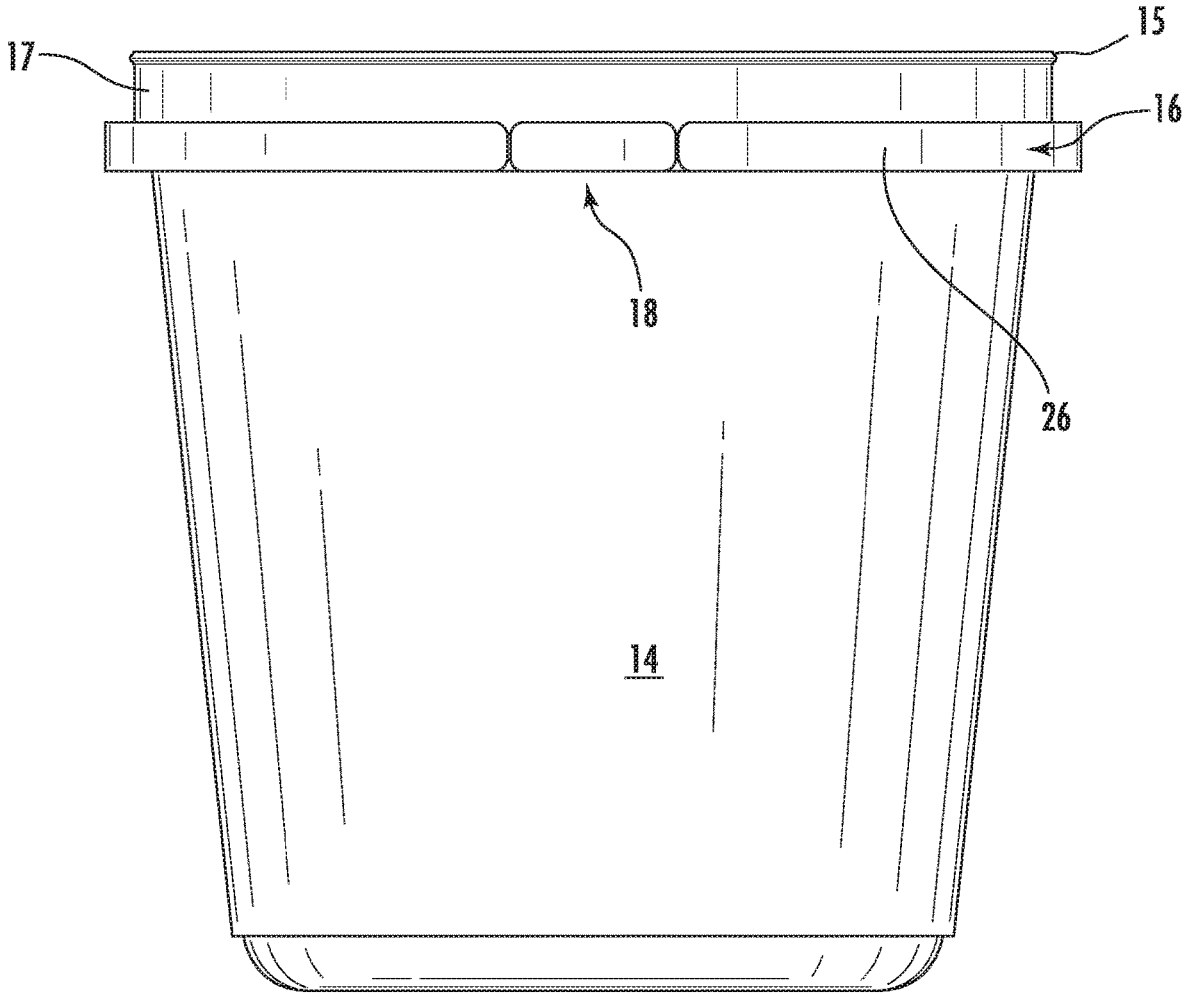
FIG. 1 is a front view of a container in an embodiment of the present invention, wherein the tab is in the closed position.

With reference to FIGS. 1-4, a container 14, tab 18, and closure 12 in accordance with an embodiment of the present invention are illustrated. FIGS. 1 and 2A illustrate a container system 10 of the invention. In FIG. 2A, the closure 12 is shown affixed to the container 14. While tab 18 is shown as the same as or similar in size to collar 16, it should be understood that in some embodiments, tab 18 may be larger or smaller than collar 16. In this way, the tab 18 may be more easily visually distinguishable from the remainder of the collar 16 and/or may be more easily accessible to the user.

In an embodiment, the container 14 comprises an integrally formed tamper evidence collar 16, as shown in the figures. Generally speaking, the tamper evidence collar 16 may overlie, hide, cover, or make inaccessible, most of the leading edge 34 of the closure 12 for the majority of the angular extension of the collar 16 when the closure 12 is applied to the container 14. In this embodiment, except as set forth herein, the closure 12 may not be removable from the container 14, due to the initial positioning of the tamper evidence collar 16. The tamper evidence collar 16 may be integrally disposed directly on the container body wall or may be disposed on an annularly extending rim 17 of the container, as shown generally in the figures.

In an embodiment, the tamper evidence collar 16 may comprise an annular portion 24 (see FIGS. 2 and 3) which extends horizontally or substantially horizontally away from the container body. In an embodiment, the annular portion 24 is perpendicular or approximately perpendicular to the container body. The annular portion 24 may comprise a raised bead portion 26, disposed adjacent the container body. The bead portion 26 may provide additional stability for the collar 16. The bead portion 26 may be rounded, but may alternatively be any shape known in the art. For example, the bead portion 26 may be square or triangular in cross section.

In an embodiment, the tamper evidence collar 16 may additionally comprise a skirt portion 28. In this embodiment, the skirt portion 28 may be parallel or substantially parallel to the container body and/or perpendicular or substantially perpendicular to the annular portion 24 of the collar. In an embodiment, the skirt portion 28 may extend vertically both upwardly and downwardly from the annular portion 24. In other embodiments, the skirt portion may extend upwardly or downwardly, but not necessarily in both directions.

In an embodiment, a plurality of ribs 31 may be disposed on the underside of the collar 16, connecting the annular portion 24, the skirt portion 28, and the container body. The ribs 31 may provide additional stability to the collar 16.

In an embodiment, the skirt portion 28 of the collar 16 extends substantially but not entirely circumferentially about the container body. In an embodiment, the skirt portion 28 of the collar 16 is discontinuous about the circumference of the container body. In an embodiment, at least the skirt portion 28 of the collar 16 is interrupted along its circumferential distance. In an embodiment, both the skirt portion 28 and the annular portion 24 of the collar 16 are interrupted along the circumferential distance of the collar 16. In the position of the discontinuity/interruption, a tamper evidence tab 18 is disposed, which completes the access limiting feature of the collar 16 for the remaining circumferential extent of the collar 16. The tab 18 may be disposed in any location, and may extend any distance, along the circumferential length of the collar 16. In an embodiment, more than one tab 18 may be presented along the circumferential length of the collar 16. In an embodiment, the raised bead portion 26 of the collar 16 is continuous along the entire circumference of the container 14.

The tab 18 may, in an embodiment, comprise a annularly extending portion 21 and a skirt portion 19. The annularly extending portion 21 of the tab 18 may be aligned with the annular portion 24 of the collar 16. Similarly, the skirt 19 of the tab 18 may be aligned with the skirt 28 of the collar 16. As noted, however, there may be a small gap between the annularly extending portion 21 of the tab 18 and the annular portion 24 of the collar 16 and/or the skirt 19 of the tab 18 and the skirt 28 of the collar 16, in each case on either circumferential side of the tab 18.

The annularly extending portion 21 of the tab 18 may, in an embodiment, have a flat upper surface. In an embodiment, the lower surface of the annularly extending portion 21 of the tab 18 may be curved. Any shape or configuration known in the art may be utilized, however. In an embodiment, the annularly extending portion 21 and the skirt 19 of the tab 18 generally comprise a "T" shape, with the skirt 19 comprising the top of the "T".

The skirt 19 of the tab 18 and/or the skirt 28 of the collar 16 may have one or more curved edges, indicating the location of the tab 18 or may be otherwise colored, shaped, and/or labeled to indicate the location of the tab 18. In any case, the tab 18 may be distinguishable from the remainder of the collar 16.

The tab 18 may be joined to the remainder of the collar 16 via one or more pins 29. For example, two pins may be disposed on either circumferential end of the tab 18. The pin(s) 29 may connect the tab 18 to the collar 16. In a particular embodiment, the pin(s) 29 may be disposed at a vertical midpoint of the skirt 19 of the tab 18 and a vertical midpoint of the skirt 28 of the collar 16. The pin(s) 29 may extend between either end of the tab 18 and the collar 16. In an embodiment, the pin(s) 29 are disposed within a channel in the skirt 28 of the collar 16 and the skirt 19 of the tab 18. In another embodiment, the pin(s) 29 are disposed within a channel in the annular portion 24 of the collar 16 and the annularly extending portion 21 of the tab 18.

The pin(s) 29 may allow the tab 18 to rotate, using the pin(s) 29 as the axis of rotation. In this embodiment, for example, the uppermost portion of the skirt 19 of the tab 18, above the pin(s) 29, may rotate outwardly, away from the container body, while the lowermost portion of the skirt 19 of the tab 18, below the position of the pin(s), may rotate inwardly, toward the container body. Due to the rotation on the pins 29, the skirt 19 of the tab 18 may be rotatable between a vertical position and an outwardly angled position. In an embodiment, the skirt 19 of the tab 18 may be rotatable between a vertical position and a horizontal position. In another embodiment, the skirt 19 of the tab 18 may be rotatable between a closed and an open position.

Other configurations of the tab 19 and pin 29 configuration are encompassed within the invention. For example, the skirt 19 and/or the skirt 28 may not have a lower portion that extends below the annular portion 24 of the collar 16 and the annularly extending portion 21 of the tab 18. In this embodiment, the pin(s) 29 could be aligned with the annular portion 24 of the collar 16 and the annularly extending portion 21 of the tab 18 without the pin(s) 29 being located at a midpoint of the skirt 19 and the skirt 28. In this configuration, the tab 18 may be generally "L" shaped. Any configuration known in the art is incorporated herein.

In an embodiment, the tab 18 is temporarily affixed to the collar 16 via one or more frangible webs 20. The frangible webs 20 may comprise thin and/or discontinuous webs which are relatively easily broken by manual pressure at the appropriate time. The one or more frangible webs 20 may be disposed, for example, on either circumferential end of the tab 18, between the skirt 19 and the skirt 28. Additionally or alternatively, a frangible web 20 may be disposed between the raised bead portion 26 of the collar 16 and the annularly extending portion 21 of the tab 18 (see FIG. 3-4).

The upper edge of the tab 18 may, in an embodiment, extend slightly above that of the skirt portion 26 of the collar 16, to distinguish the tab 18 from the remainder of the collar 16. In an embodiment, there is a gap between the upper edge of the skirt 19 of the tab 18 and the container body and/or the rim 17 of the container such that a user can insert the tip of his finger, or even a fingernail, in the gap to actuate the tab 18.

FIG. 4 illustrates a cross sectional view of the closure 12 in relation to the container 14 and the tab 18. As shown, the container 14 may have an outwardly extending rib or ledge 15 at or near its upper rim. The ledge 15 may be configured to be engageable with an inwardly extending rib or ledge 13 of the closure 12. Although elements 15 and 13 are shown as interlocking ledges, any mechanism known in the art to securely attach a lid to a container may be utilized. For example, a matching groove and ridge could be utilized or a snap-fit configuration could be utilized.

In an embodiment, the closure 12 is securely applied to the container 14 after the container has been filled. In an embodiment, the closure 12 comprises a vertical or substantially vertical skirt portion 11 which is sized and configured to fit between the collar 16 and tab 18, on the one hand, and the container body or rim 17, on the other hand. The closure skirt portion 11 may fit securely between the skirt portion 19 of the tab 18 and the raised bead portion 26 of the container 14, in an embodiment. In an embodiment, the closure skirt portion 11 may be seated atop the annularly extending portion 21 of the tab 18 and the annular portion 24 of the container 14. In an embodiment, the raised bead portion 26 of the container 14 is curved on its top surface, which allows the closure 12 skirt portion 11 to be guided into position atop the annularly extending portion 21 of the tab 18 and the annular portion 24 of the container 14.

As will be appreciated, when the tab 18 is in its closed position (shown in FIGS. 1 and 4A), the lower edge of the skirt 11 of the closure 12 is not visible or accessible from the outside of the package. This prevents tampering with the container unless and until the tab 18 is actuated to allow access into the container 14.

Figure 2A:
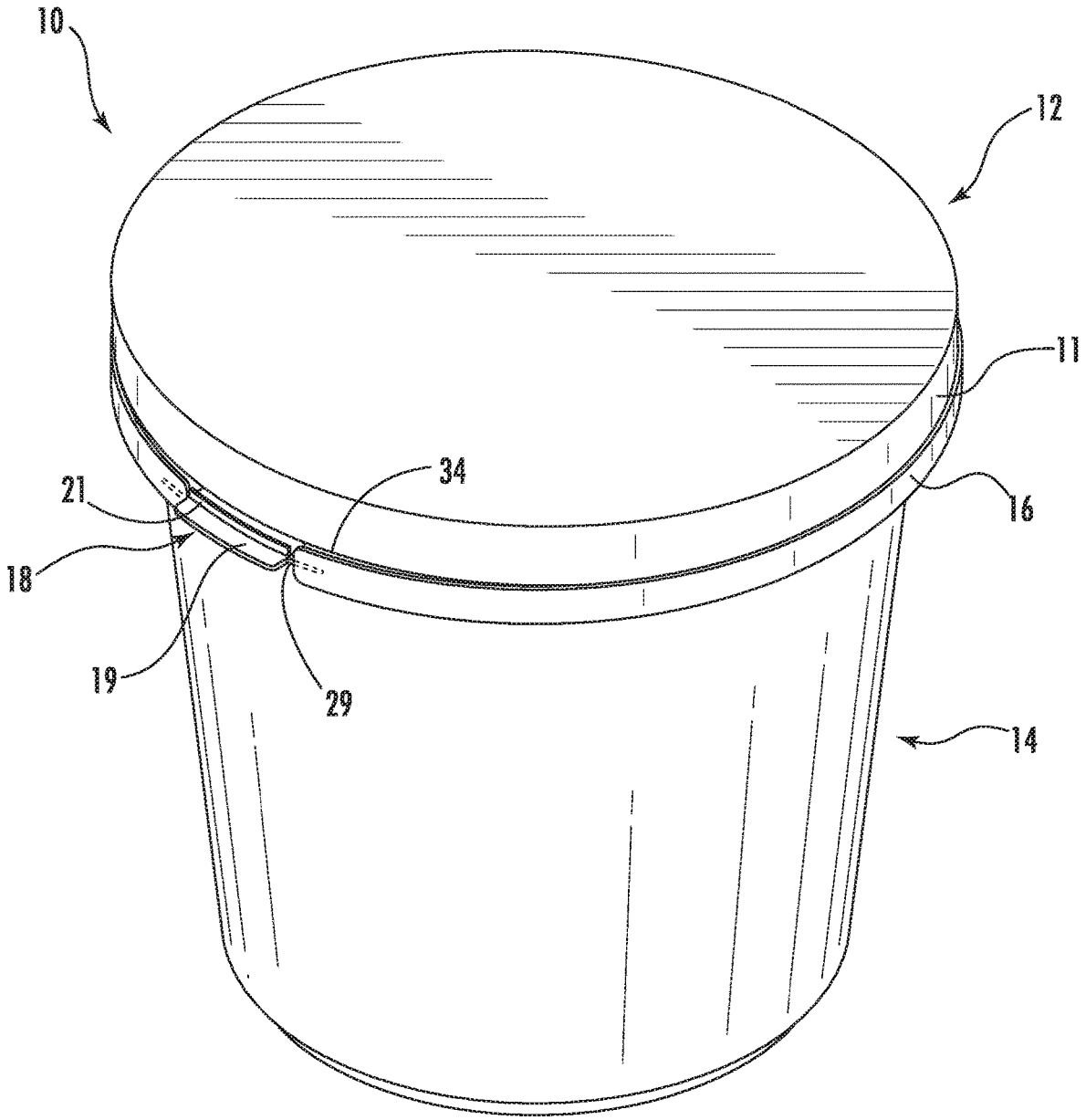
FIG. 2A is a perspective view of a container and closure system in an embodiment of the present invention, wherein the tab is in the open position.
Figure 2B:
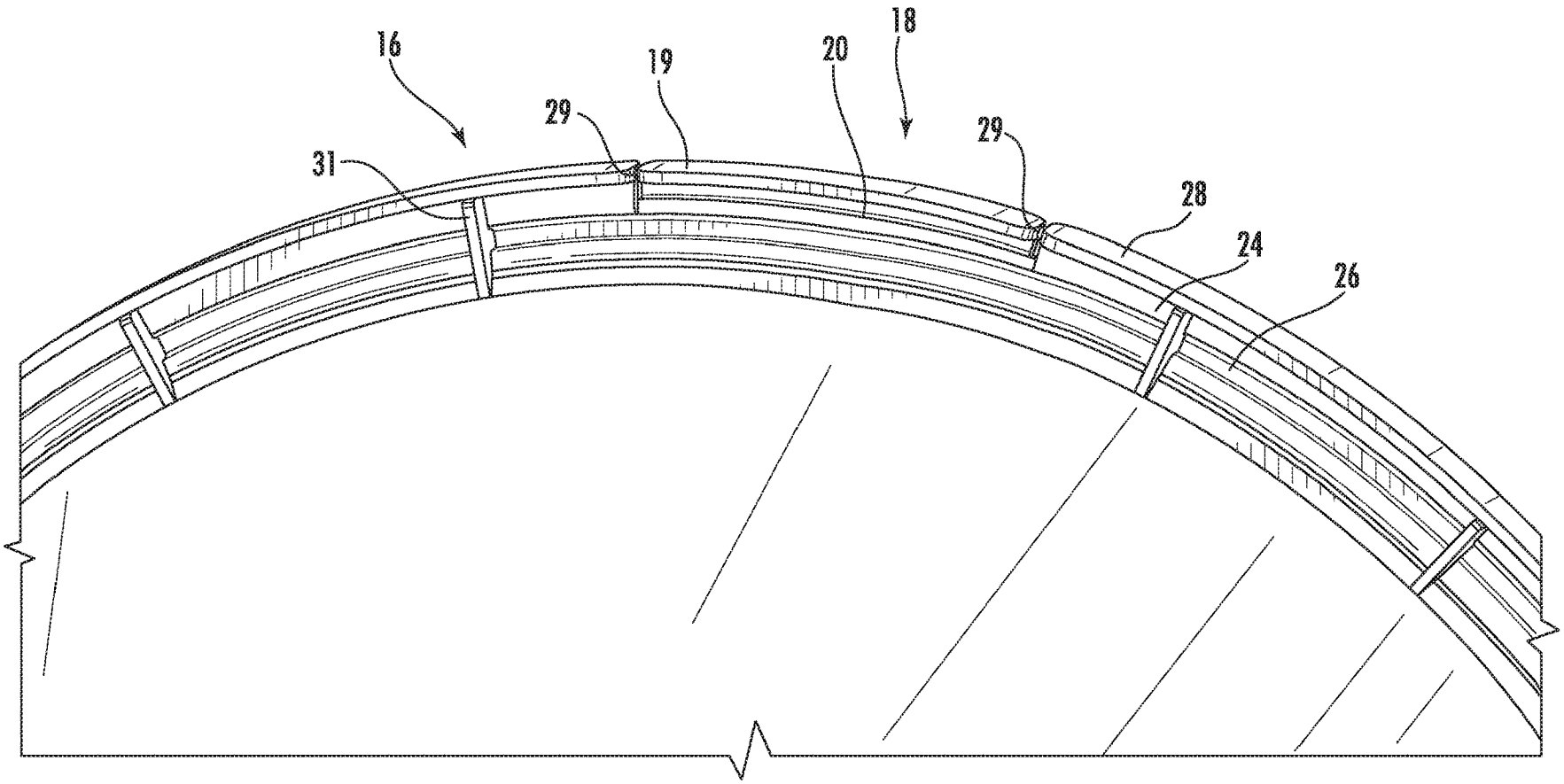
FIG. 2B is a bottom exploded perspective view of the tab portion of the container in an embodiment of the present invention, wherein the tab is in the closed position.
Figure 3A:
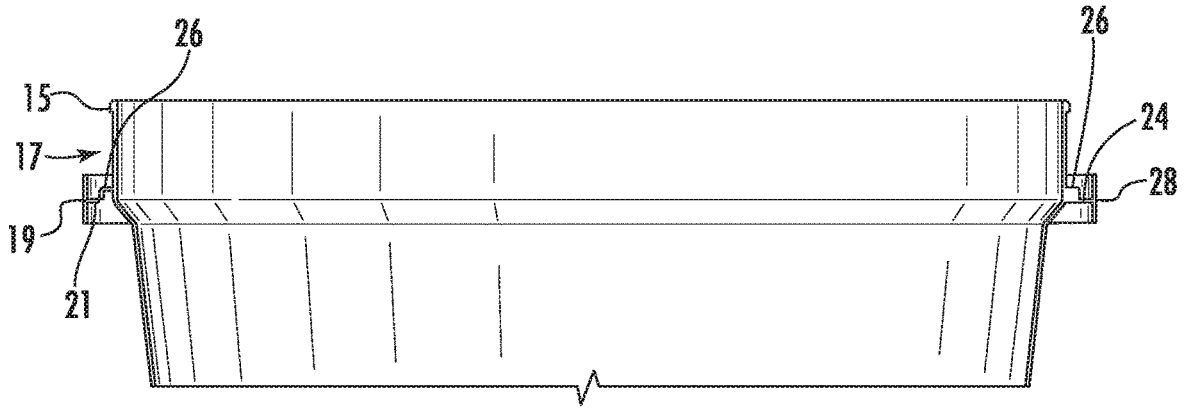
FIG. 3A is a cross-sectional view of the container in an embodiment of the present invention.
Figure 3B:
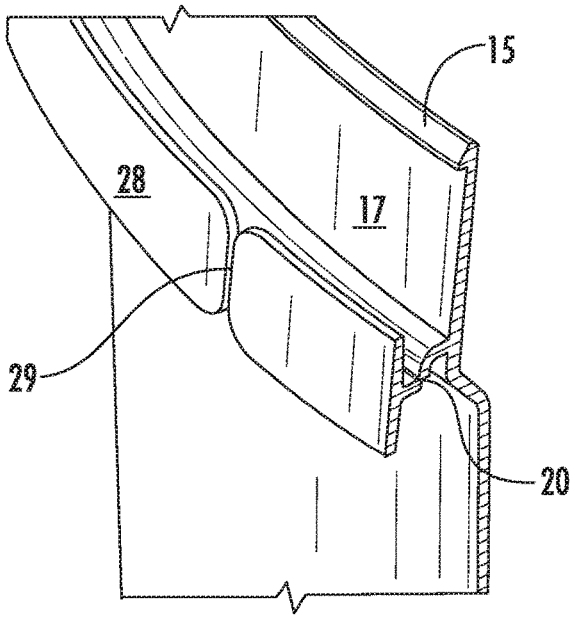
FIG. 3B is a top, perspective cross-sectional view of the container in an embodiment of the present invention.
Figure 3C:
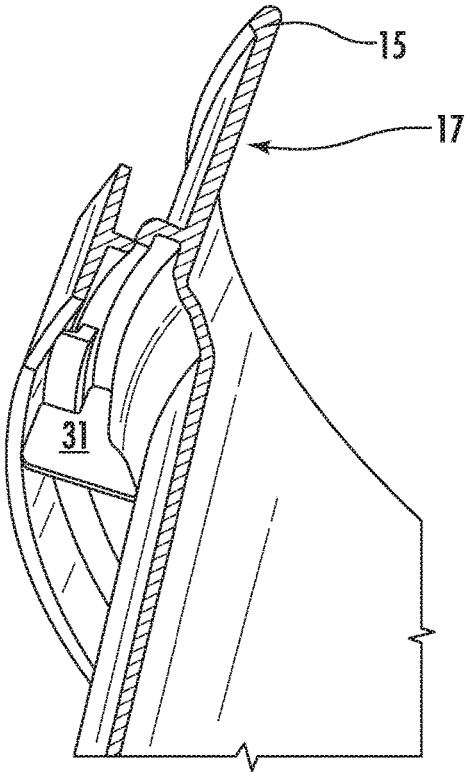
FIG. 3C is a bottom, perspective cross-sectional view of the container in an embodiment of the present invention.
Figure 3D:
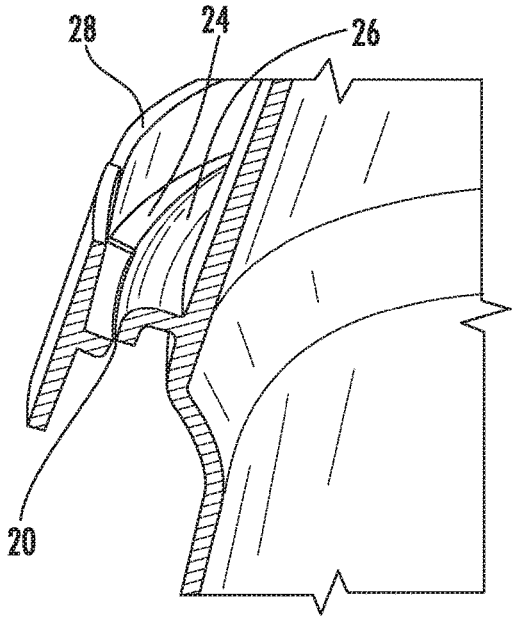
FIG. 3D is a top, perspective cross-sectional view of the container in an embodiment of the present invention.
Figure 3E:
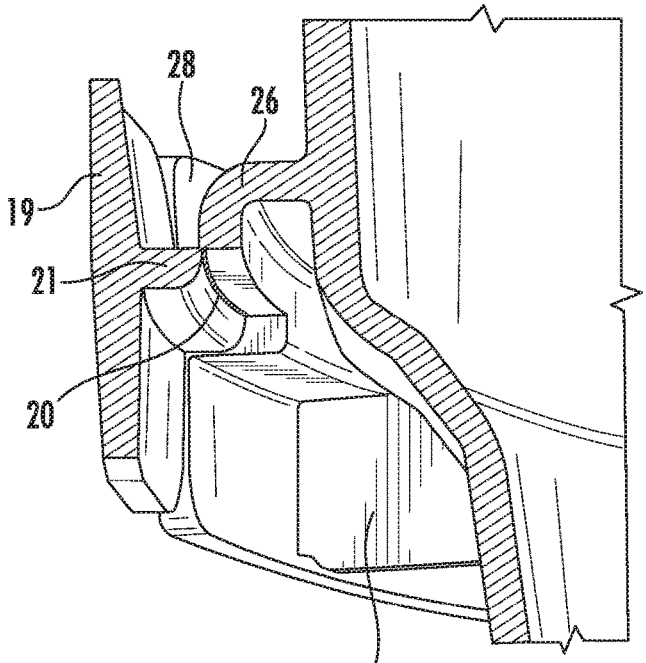
FIG. 3E is a bottom, perspective cross-sectional view of the container in an embodiment of the present invention.
Figure 3F:
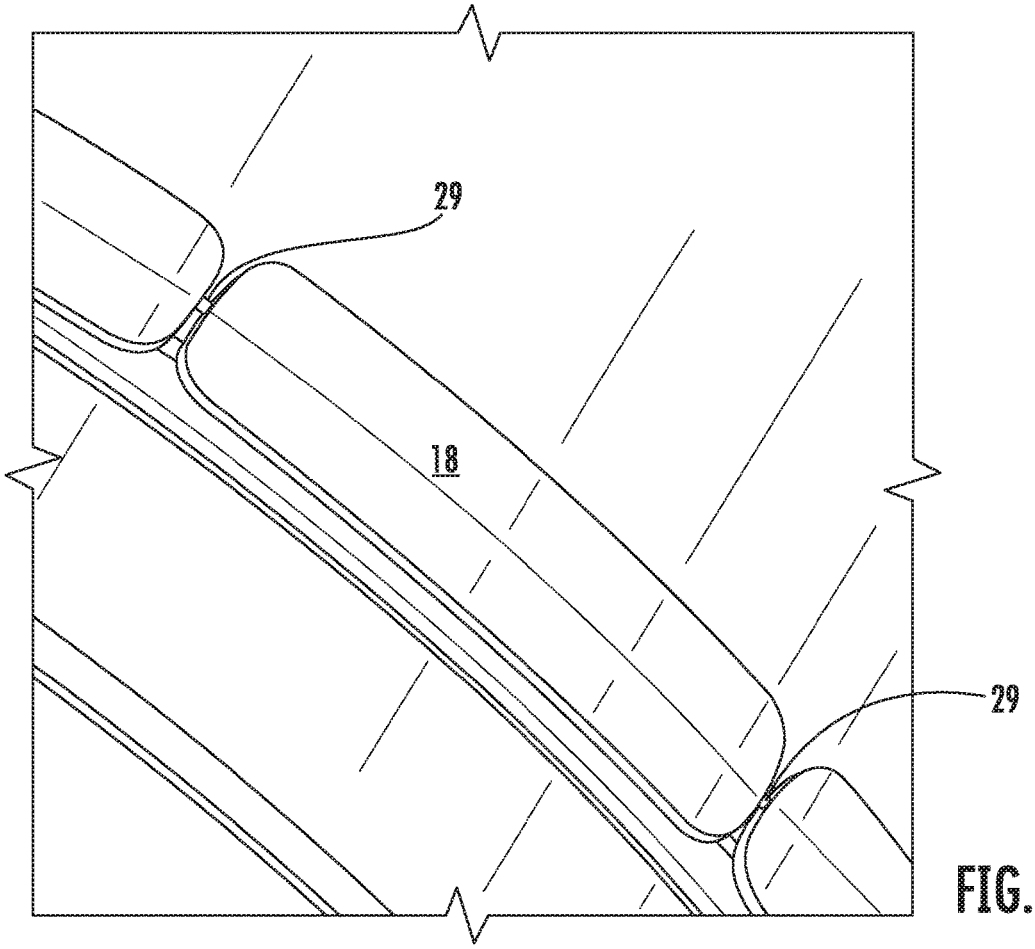
FIG. 3F is a front exploded view of the tab portion of the container in an embodiment of the present invention, wherein the tab is in the closed position.
Figure 3G:
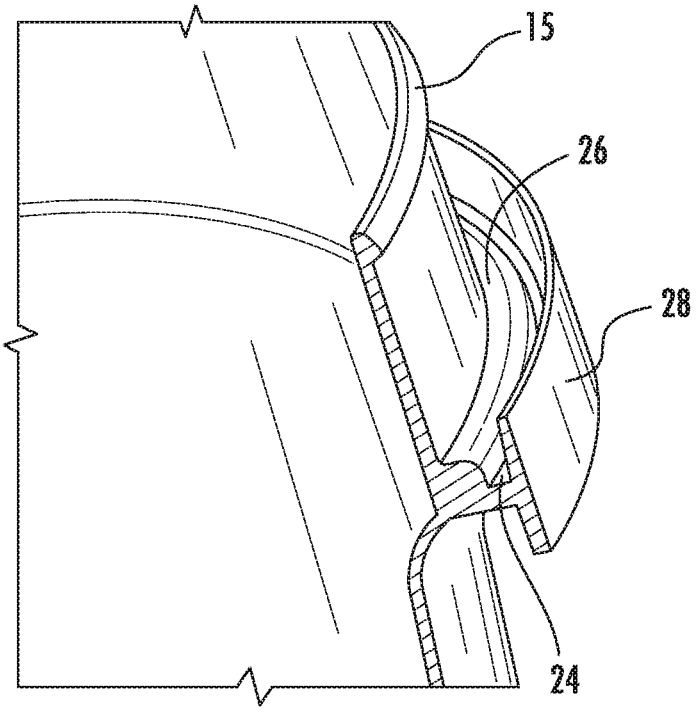
FIG. 3G is a top, perspective cross-sectional view of the container in an embodiment of the present invention.
Figure 3H:
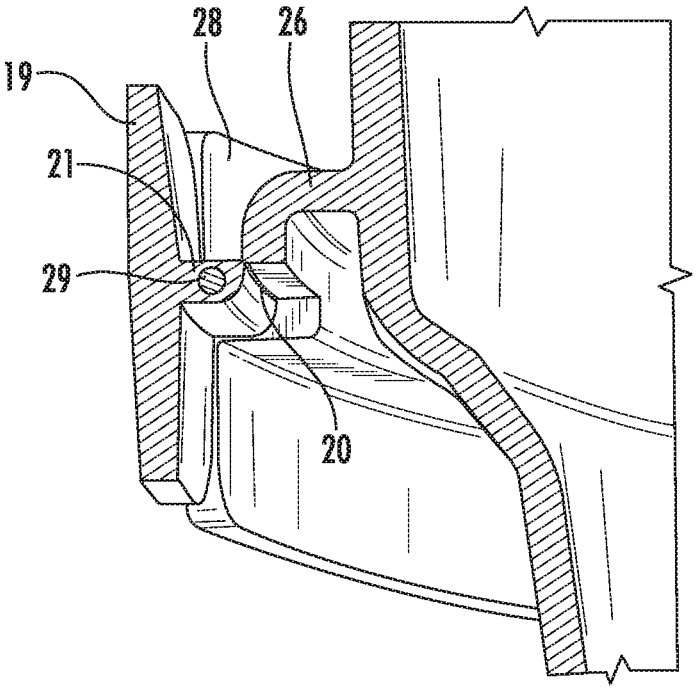
FIG. 3H is a bottom, perspective cross-sectional view of the container in an embodiment of the present invention.
Figure 4A:
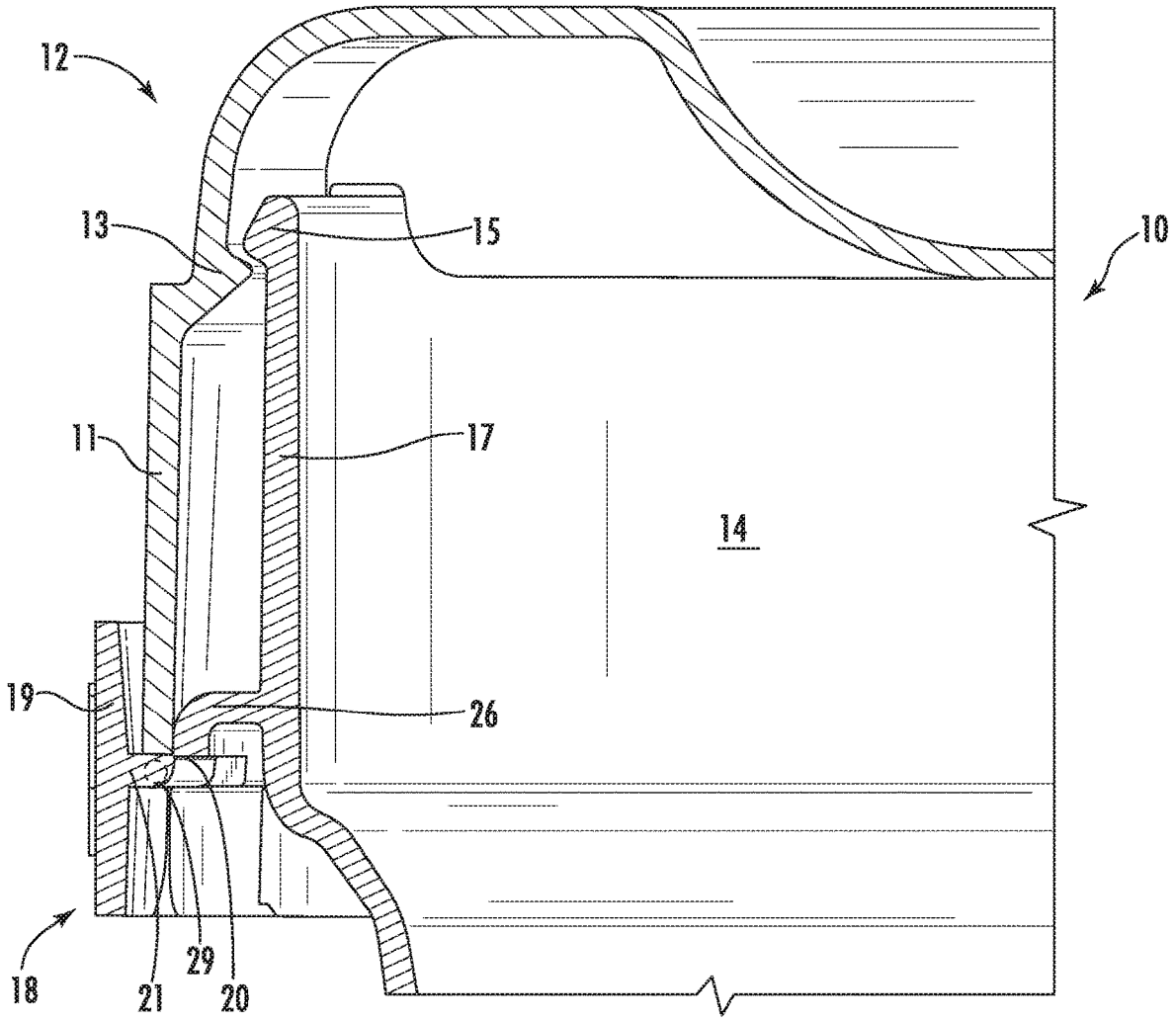
FIGS. 4A-4C are a cross-sectional of a container and closure system in an embodiment of the present invention, wherein the tab moves from the closed position to the open position.
Figure 4B:
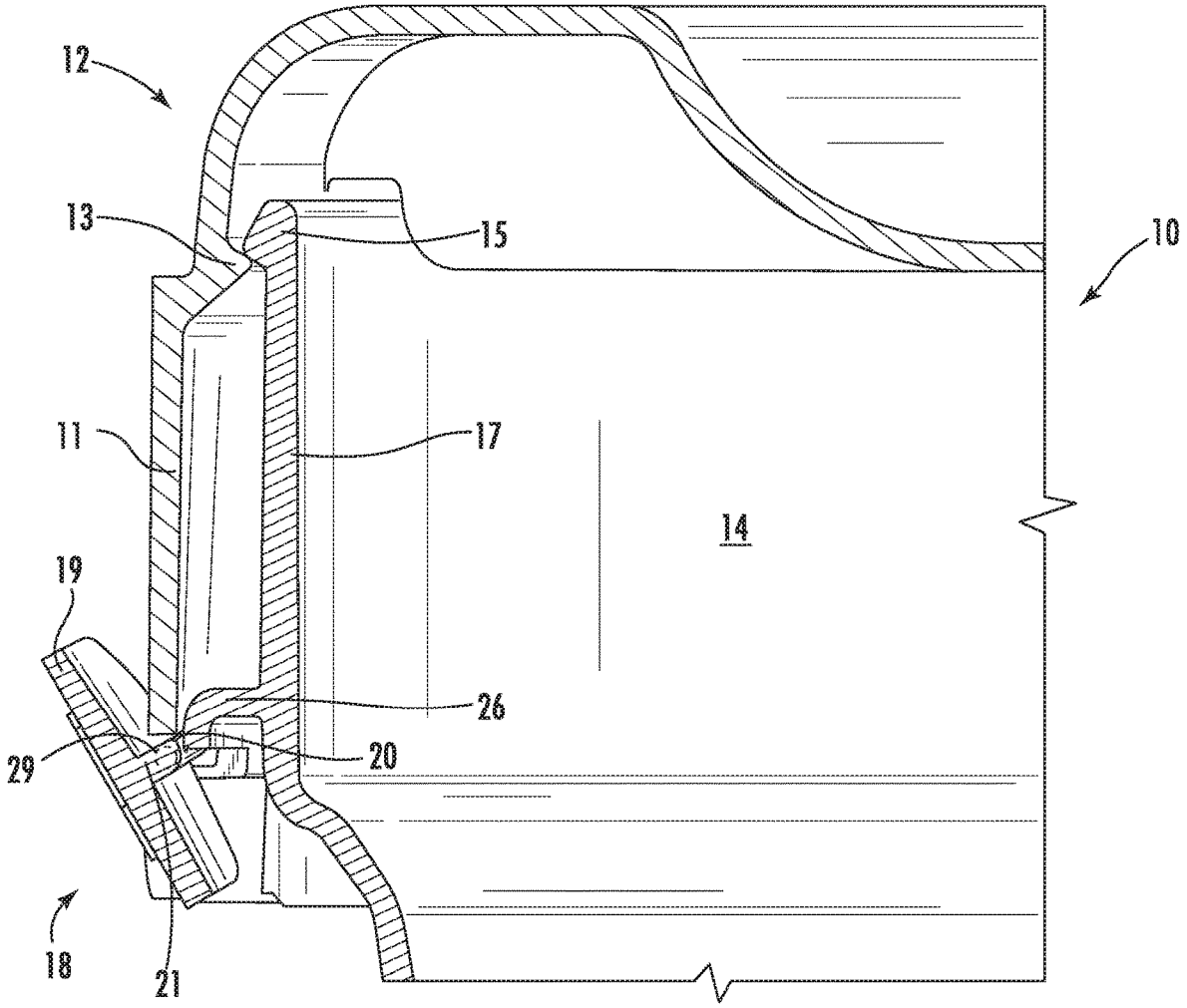
Figure 4C:
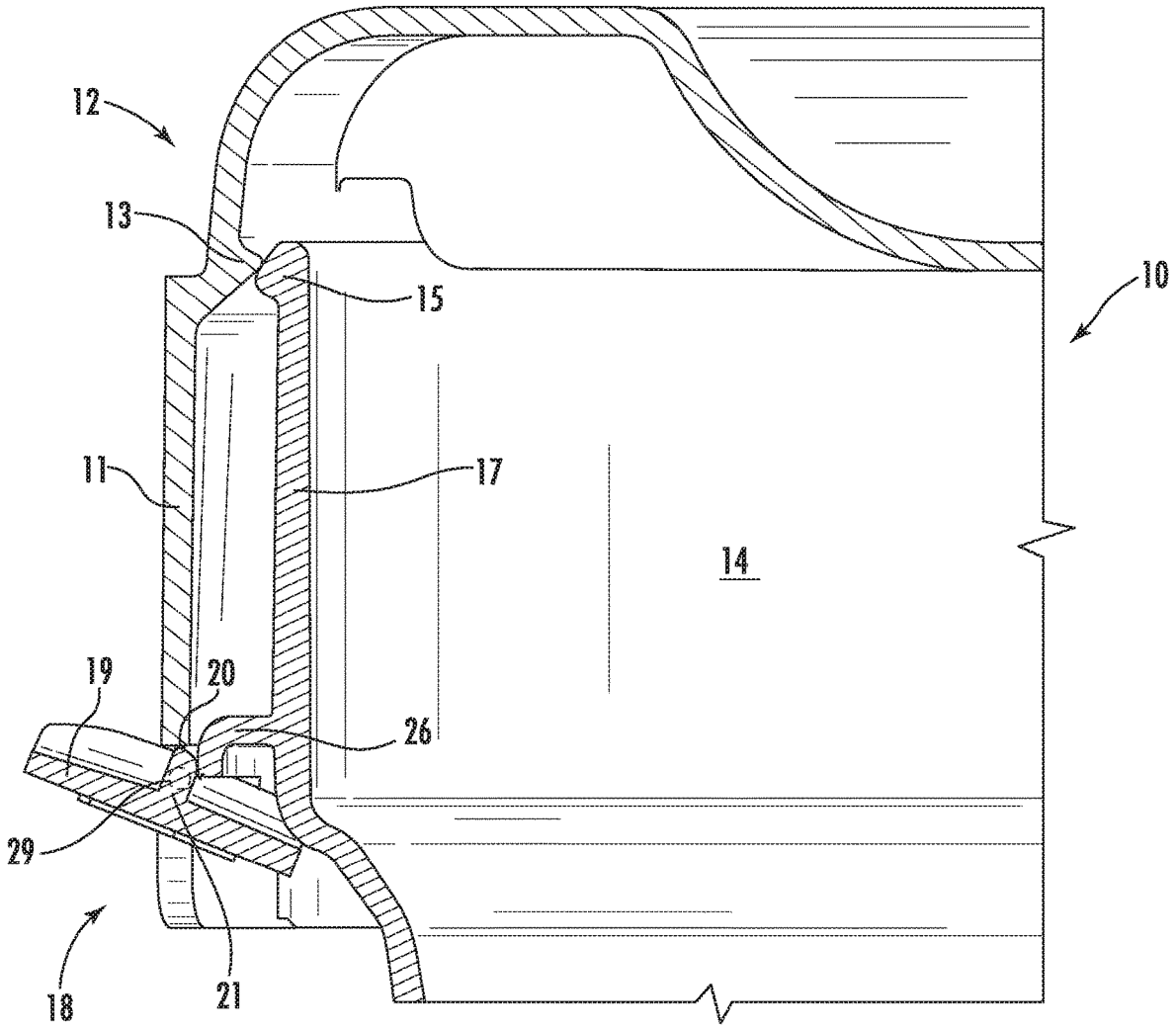

In an embodiment of the invention shown in FIGS. 2, 4B and 4C, to remove the closure 12 from the container 14, the user may insert a finger in the gap near the top of the tab 18 and pull the tab 18 outwardly until the frangible portion 20, if present, breaks and the tab 18 rotates on the pins 29. As the tab 18 rotates outwardly, the lower edge 34 of the skirt 11 of the closure 12 becomes visible and accessible and may then be accessed by the user and pulled upwardly using one or more fingers, thereby lifting the closure 12 away from the container 14. It will be appreciated that this removal is achieved without damage or alteration of any kind to the closure 12 itself. Thus, the closure 12 retains its sealing qualities throughout the period in which it is associated with the container 14 and may be removed and replaced as often as is desired or necessary.

Once the frangible portion 20 is broken, tamper evidence cannot be assured. Thus, a user will know that if the tab 18 is freely rotatable on the pins 29, the container 12 contents may have been accessed. Accordingly, tab 18 is a functional tamper evidence mechanism.

In another embodiment of the invention, the process of actuating the tab 18 may actually lift the closure upwardly and, in some embodiments, initiate the removal of the closure 12 from the container 14. This embodiment is shown in FIGS. 4A-4C. In this embodiment, the closure 12 skirt portion 11 may be seated atop the annularly extending portion 21 of the tab 18. As the tab 18 is rotated outwardly, shown progressively in FIGS. 4B and 4C, the annularly extending portion 21 of the tab 18 exerts upward pressure on the skirt 11 of the closure 12. The skirt 11 of the closure, and the closure 12 itself, are pushed upwardly as the tab 18 is rotated outwardly. In an embodiment, the ledge 13 of the closure 12 is pushed up and over ledge 15 of the container 14 such that they are disengaged. The closure 12 can then be easily removed from the container 14.

The tab 18, because it is permanently attached to the collar 16 via the pins 29, does not become an element of refuse, does not become a swallowing/choking hazard, and cannot find its way into the interior of the container 14.

The container 14 and/or closure 12 of the container system 10 may be formed from any material known in the art. For example, the container 14 body may comprise a paperboard material that is spirally wound into a tubular container body. In other embodiments, the container 14 and/or closure 12 may comprise papers, metals, metalized layers, plastics or polymers and may be formed by any number of methods, such as injection molding, thermoforming or blow molding. In some embodiments, the container 14 and/or closure 12 comprise a combination of one or more materials or laminated layers. The container 14 and/or closure 12 may include a liner material to provide sufficient barrier properties to the container system.

In an embodiment, the container and closure of the invention may be child resistant. In this embodiment, it may not be obvious to a child that the tab must be actuated to open the container or it may be too difficult for a child to easily actuate the tab to open the container.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container comprising a container body and a tamper evidence collar integrally formed on the container body, wherein the tamper evidence collar comprises:

an annular portion which extends circumferentially outwardly from the container body;

a discontinuous skirt portion which extends vertically from the annular portion, extends substantially circumferentially about the container body;

a tamper evidence tab disposed in the circumferential location of the skirt discontinuity, wherein the tab comprises:

an annularly extending portion aligned with the annular portion of the collar; and a skirt portion aligned with the skirt of the collar, one or more pins that rotatably join the tab to the tamper evidence collar; and at least one frangible web which connects the tab to the tamper evidence collar prior to actuation of the tab.

2. The container of claim 1, wherein the tamper evidence collar is located near an upper rim of the container body.

3. The container of claim 1, wherein both the skirt portion and the annular portion of the collar are discontinuous in the location of the tab.

4. The container of claim 1, wherein the annular portion additionally comprises a raised bead portion disposed adjacent the container body.

5. The container of claim 4, wherein the raised bead portion is continuous along the entire circumference of the container body.

6. The container of claim 4, wherein the annular portion is discontinuous in the circumferential location of the skirt discontinuity.

7. The container of claim 4, wherein the frangible web is disposed between the raised bead portion of the collar and the annularly extending portion of the tab.

8. The container of claim 1, wherein the tab comprises a "T" shape, with the skirt of the tap comprising the top of the "T".

9. The container of claim 1, wherein the pins are disposed at a vertical midpoint of the skirt of the tab and a vertical midpoint of the skirt of the collar.

10. The container of claim 1, wherein the pins join the skirt of the collar and the skirt of the tab.

11. The container of claim 1, wherein the pins join the annular portion of the collar and the annularly extending portion of the tab.

12. A container and closure system comprising:

a container body, a tamper evidence collar integrally formed on the container body, wherein the collar comprises:

an annular portion which extends circumferentially outwardly from the container body;

a discontinuous skirt portion which extends vertically from the annular portion, extends substantially circumferentially about the container body;

a tamper evidence tab disposed in the circumferential location of the skirt discontinuity, wherein the tab comprises:

an annularly extending portion aligned with the annular portion of the collar; and a skirt portion aligned with the skirt of the collar, one or more pins that rotatably join the tab to the tamper evidence collar; and at least one frangible web which connects the tab to the tamper evidence collar prior to actuation of the tab;

a closure which can be removably fitted on the container body.

13. The system of claim 12, wherein the tamper evidence collar covers a lower edge of a skirt of the closure when the tamper evidence tab is in its closed position.

14. The system of claim 12, wherein the lower edge of a skirt of the closure is accessible when the tamper evidence tab is in its open position.

15. The system of claim 12, wherein the container body additionally comprises an outwardly extending ledge and the closure additionally comprises an inwardly extending ledge, and wherein the outwardly and inwardly extending ledges can be removably interlocked.

16. The system of claim 12, wherein the closure comprises a skirt portion that is disposed between the collar and tab on the one hand and the container body on the other hand.

17. The system of claim 12, wherein the closure comprises a skirt portion that is disposed atop the annularly extending portion of the tab and the annular portion of the container body.

18. A method of using the container and closure system of claim 12 comprising:

pulling a top portion of the tab outwardly until the frangible portion breaks and the tab rotates on the pins;

when the lower edge of the skirt of the closure becomes accessible, pulling upwardly on the closure, away from the container.

19. The method of claim 18 wherein when the tab is pulled outwardly, the annularly extending portion of the tab exerts upward pressure on the skirt of the closure and the skirt of the closure is pushed upwardly.

20. The method of claim 19, wherein the container body additionally comprises an outwardly extending ledge and the closure additionally comprises an inwardly extending ledge, and wherein the outwardly and inwardly extending ledges are removably interlocked prior to actuation of the tab, and wherein the ledge of the closure is pushed up and over the ledge of the container such that they are disengaged.

* * * * *